United States Patent [19]

Balducci et al.

[11] Patent Number: 4,498,319

[45] Date of Patent: Feb. 12, 1985

[54] EXIT DEVICE

[75] Inventors: Walter O. Balducci; Theodore H. Miller, both of New Britain, Conn.

[73] Assignee: Emhart Industries, Inc., Farmington, Conn.

[21] Appl. No.: 381,604

[22] Filed: May 24, 1982

[51] Int. Cl.[3] ..... E05B 65/10

[52] U.S. Cl. ..... 70/92; 70/149; 70/218; 70/472; 70/489; 292/92; 292/DIG. 26; 292/DIG. 27

[58] Field of Search ..... 70/92, 224, 105, 106, 70/198, 199, 204, 472, 489, DIG. 73, 141, 142, 144, 145, 149, 150, 153, 422, 218; 292/DIG. 26, DIG. 27, 21, 92, 226

[56] References Cited

U.S. PATENT DOCUMENTS

| | | | |
|---|---|---|---|
| 917,685 | 4/1909 | Voight | 292/92 |
| 1,564,030 | 12/1925 | Soemer | 70/92 |
| 1,701,099 | 2/1929 | Clark | 70/92 |
| 1,960,410 | 5/1934 | Christensen | 70/218 |
| 2,065,291 | 12/1936 | Ritterbusch | 70/153 |
| 2,916,903 | 12/1959 | Squire | 70/218 |
| 4,309,884 | 1/1982 | Davis | 70/149 X |
| 4,320,642 | 3/1982 | Pastva, Jr. | 70/218 X |

FOREIGN PATENT DOCUMENTS

| | | | |
|---|---|---|---|
| 3491 | of 1908 | United Kingdom | 292/226 |

*Primary Examiner*—Robert L. Wolfe
*Assistant Examiner*—Lloyd A. Gall
*Attorney, Agent, or Firm*—H. Samuel Kieser

[57] ABSTRACT

An exit device including a latch bolt and an action lever. The action lever includes a cam lever pivotably connected thereto and having a first portion engaging a locking member and a second portion engaging the latch bolt the cause the retraction thereof as the action lever is pivoted into its open position when a locking member is in an unlocked position. When the locking member is in the locked position, the first portion of the cam lever is free of engagement of the locking member and a second portion is free to cam about the latch bolt upon pivoting of the action lever into its open position whereby the latch bolt is not retracted.

12 Claims, 9 Drawing Figures

EXIT DEVICE

This invention relates to an exit device and more specifically to an exit device of the rim type having a pivoted latch bolt which projects from the side of the active case.

Locks of the above type are commonly used on outwardly opening exit doors of public buildings such as schools, hospitals, theaters and the like where large numbers of people can be expected to gather. These devices permit quick and easy access from the building at all times and particularly in cases of emergency such as fire or accident.

The latch bolt retracting mechanism of such locks is, for reasons of safety, operable at all times by means of a cross bar which extends horizontally across the inner side of the door. The cross bar is pivotably mounted at one end to the "active" lock case, that is, the lock case which carries the latch bolt and the retracting mechanism therefor, and at its opposite end to an "inactive" or supporting case which is secured to the inner side of the door opposite the active case. Generally, the latch bolt is retracted by the depression of the cross bar which is particularly important since this will assure automatic retraction of the latch bolt if people should crowd against the inside of the door.

In addition to the basic function which merely provides for cross bar retraction of the latch bolt from the inside of the door, in some instances such devices have been furnished with manually operated means for controlling the operation of the latch bolt from outside the door. Such manually operated devices may be in the form of a thumb piece or lever located on the outer side of the door and which are operable upon depression to retract the latch bolt. In those instances where a device for operating the latch bolt is provided on the outside of the door, key operated means are usually provided for rendering such devices inoperable.

According to one type of device in common use prior to this invention, a lever member was pivotably mounted in the active case. An external manually operated member in the form of a thumb piece or the like was used to pivot the lever which in turn engaged an extension portion on the latch bolt causing it to retract. A key operated lock cylinder was also provided which was connected to a locking hub mounted in the case which in turn caused a locking member to be moved into and out of locking engagement with the lever. With the locking member in locking engagement with the lever, the lever was prevented from moving and thus, would not be able to cause retraction of the latch bolt. However, in such case, the external operating member was also rendered immovable. Thus, in the event the external locking member was forced, damage could result to the operating member and/or the mechanism within the case.

SUMMARY OF THE INVENTION

In view of the above, it is an object of the present invention to provide an improved exit device.

More specifically, it is an object of the present invention to provide an exit device which will permit an operating member on the outer side of the door to move without causing retraction of the latch bolt when the device is locked.

These and other objects of the invention may be achieved by an exit device having a latch bolt which is supported by and movable relative to the active case between projected and retracted positions. An action lever is pivotably mounted in the active case and is adapted to be pivoted by a manual operator between an open and closed position. A locking member is mounted in the case for movement between a locked position and an unlocked position. A cam lever is pivotably connected to the action lever adjacent one end thereof and has a first portion for engaging the locking member and a second portion for engaging and causing the retraction of the latch bolt as the lever is pivoted into its open position when the locking member is in the unlocked position. When the locking member is in the locked position the first portion of the cam lever is free of engagement of the locking member and the second portion is free to cam about the latch bolt upon pivoting of the action lever into its open position whereby the latch bolt remains projected.

BRIEF DESCRIPTION OF THE DRAWINGS

The present invention will be more readily understood by reference to the following detailed description and to the accompanying drawings in which.

DETAILED DESCRIPTION

Figure 1:
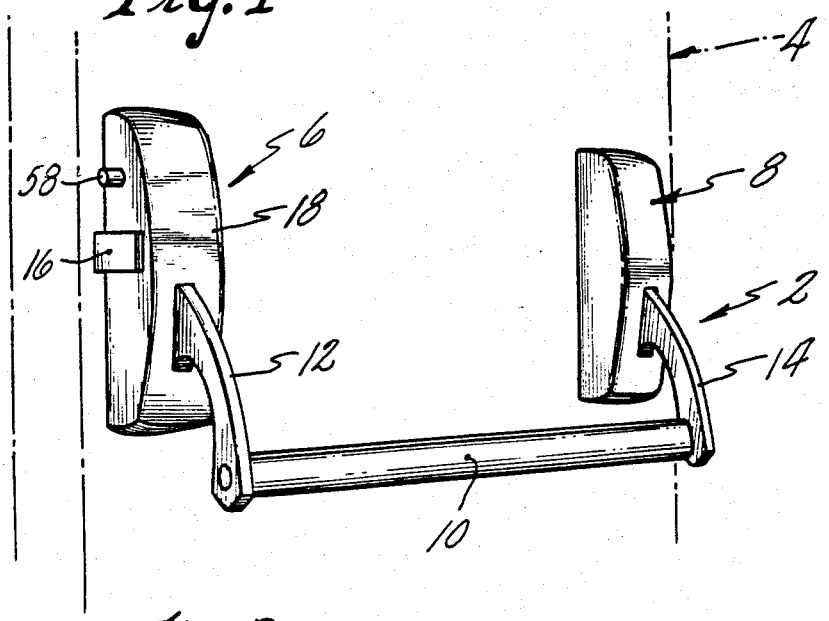
FIG. 1 is a perspective view showing an exit device mounted on a door shown in phantom.

Referring to the drawings, and in particular FIG. 1, an exit device 2 is shown attached to a door 4 shown in phantom. The exit device comprises generally an active case 6 and an inactive case 8. A cross bar 10 is mounted between an active lever 12 and an inactive lever 14. The levers 12 and 14 are pivotably mounted within cases 6 and 8 respectively. The latching mechanism housed within the active case 6 is operable upon depression of the cross bar 10 to cause retraction of a latch bolt 16.

Figure 3:
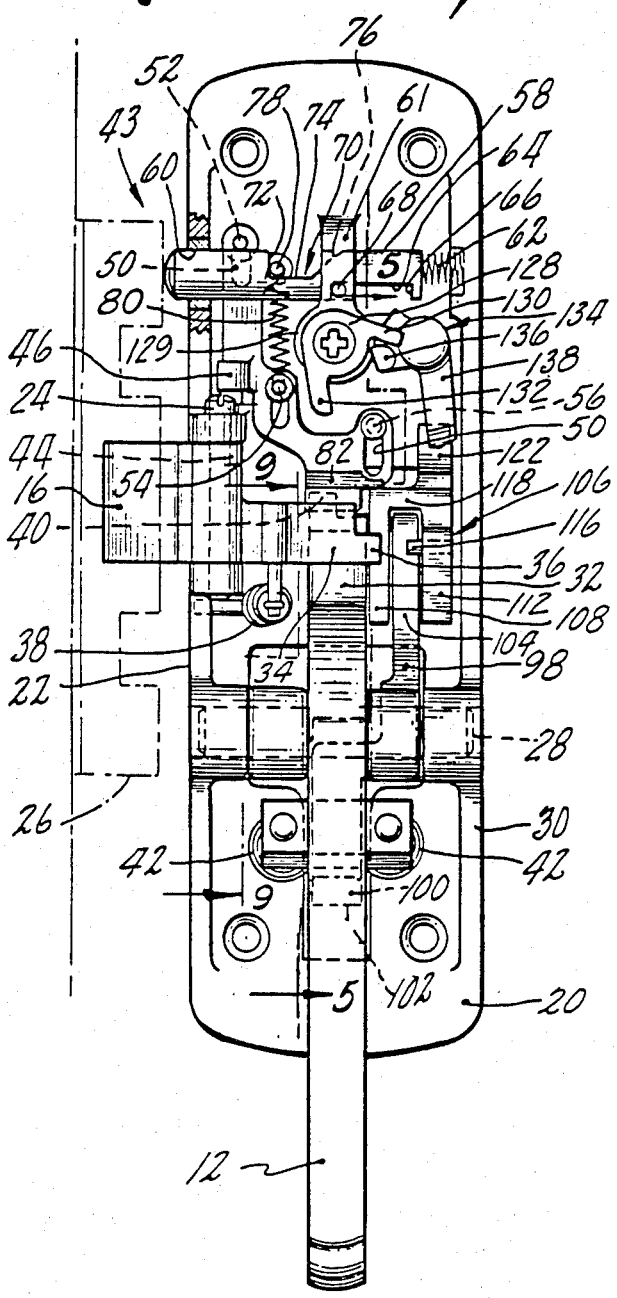
FIG. 3 is a front elevational view of the active case of FIG. 1 with the cover removed and the components shown in the unlocked position.

The active case 6 includes a cover 18 and a backplate 20 attached to the door 4 and which is shown in FIG. 3. The latch bolt 16 is pivotably mounted to a wall 22 which extends outwardly from the backplate 20 by means of pivot pin 24. When the door 4 is closed, the latch bolt 16 is adapted to mate with a strike 26 shown in phantom in FIGS. 3 and 4 to prevent opening of the door unless the latch bolt 16 is retracted.

Figure 9:
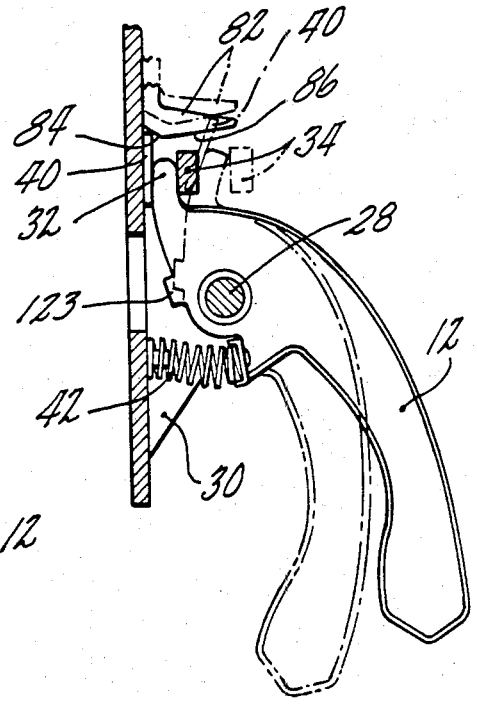
FIG. 9 is a partial sectional view taken along the line 9—9 of FIG. 3.

The active lever 12 is pivotably mounted within the case 6 by means of a pivot pin 28 extending between the wall 22 and a wall 30 which projects outwardly from the backplate 20. The lever 12 includes an upwardly extending projection 32 at its inner end. The latch bolt 16 includes a transversely extending projection 34 positioned outside of the projection 32 on the lever 12 and which has a tail portion 36 which extends tranversely beyond the projection 32. The latch bolt 16 is biased into its projected position by means of a coil spring 38. The lever 12 has an extension tab 40 mounted on the rear surface of the projection 32 and extending upwardly therefrom as shown in FIG. 9. Lever 12 is biased into its closed position, wherein the extension tab 40 abuts the base plate 20 by means of springs 42.

A dead locking mechanism 43 is provided in the interior of the active case 6 and includes a locking pin 44 extending downwardly from a boss 46 on a retractor member 48. The retractor member 48 includes three vertically extending slots 50 in which pin members 52, 54 and 56, which extend outwardly from the backplate 20, are received to guide the retractor in its vertical movement. A plunger 58 is mounted in a boss 61 extending outwardly from the backplate 20 and extends transversely in front of the retractor 48 through an opening 60 in the side wall 22. A spring member 62 biases the plunger 58 in a transverse direction toward its extended position out of the case 6. The bottom portion of the plunger 58, adjacent the end opposite the opening 60, is provided with a cut-out 64 forming a stop 66 which, when the door is in an open position and the plunger 58 is extended, abuts against a rollpin 68 extending through the boss 61.

The top side of the plunger 58 is also provided with a cut out 70 intermediate its ends. The cut-out 70 includes a vertical end face 72, a horizontal transversely elongated dwell portion 74 and a sloping cam portion 76. A pin member 78 extends outwardly from the retractor through the cut-out portion 70 of the plunger 58. A spring member 80 is attached to the pin member 78 and extends downwardly forward of the plunger 58 to an extension of the pin member 54 which is mounted on the backplate 20. The spring member 80 serves to urge the retractor member 48 and its associated pin member 44 downwardly so that the pin 78 rests on the dwell portion of the cut-out when the plunger 58 is retracted by the strike 26 as shown in FIG. 3 when the door is closed. With the retractor member 48 in this position, the locking pin 44 extends downwardly past the top portion of the latch bolt 16 along its inside surface whereby the latch bolt 16 is prevented from being retracted.

The bottom portion of the retractor member 48 includes an outwardly extending cam arm 82 extending over the extension tab 40 on the lever 12. The cam arm 82 on its bottom surface includes a first downwardly sloping cam surface 84 and a second upwardly sloping surface 86.

With the door in the closed position, the latch bolt 16 is in its projected position and the plunger 58 is held in its retracted position by the strike 26. The retractor 48 is in its lower position with the pin member 44 preventing retraction of the latch bolt 16. When the cross-bar 10 is depressed, lever 12 pivots about pivot pin 28 and, as shown in FIG. 9, the extension tab 40 engages the cam surface 84 and then 86 of the cam arm 82 and raises the retractor member 48, thus raising the locking pin 44 out of the path of the latch bolt 16. At the same time, the projection 32 of lever 12 engages the rearward portion of the projection 34 of the latch bolt 16 causing the latch bolt to be pivoted into the case 6 into its retracted position.

As the door is opened and the plunger 58 moves from the strike 26, it moves into its extended position whereupon the stop 66 abuts against the rollpin 68. In so doing, the pin 78 attached to the retractor member 48 is cammed upwardly by the cam portion 76 of the cut-out 70 and rests on the top surface of the plunger 58. The locking pin 44 on the retractor member 48 is then held in its upper inoperative position until the door 4 is closed.

Figure 2:
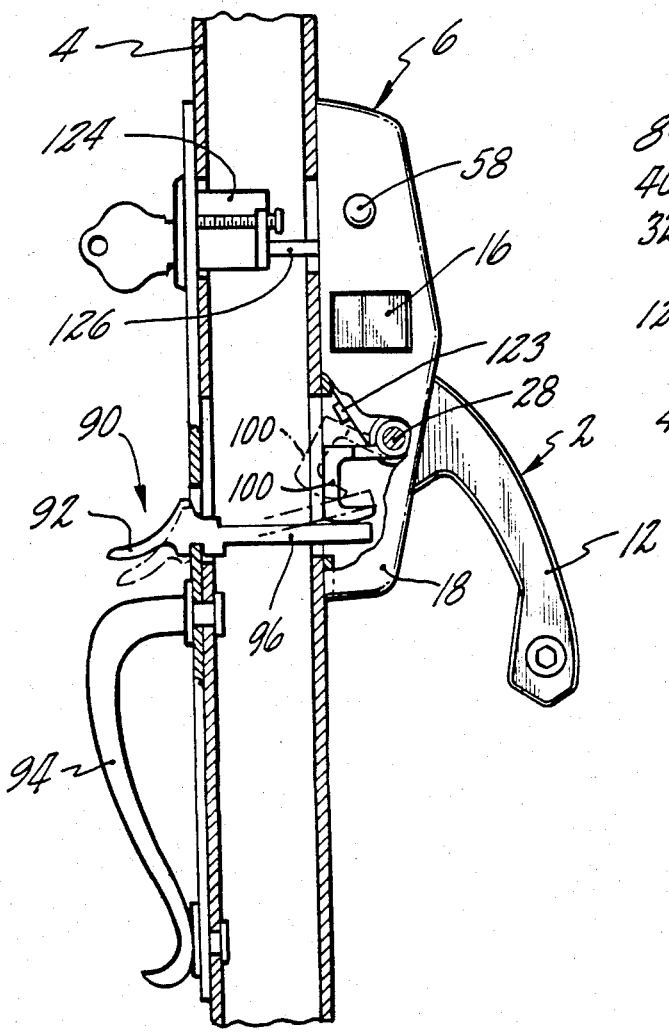
FIG. 2 is a side elevational view partially in section of the active case shown in FIG. 1.

The exit device 2 of the present invention includes an external manual operator 90 on the outside of the door 4 which may be in the form of a thumb piece, lever or other suitable well-known type operator. As shown in FIG. 2, in the example given, the manual operator 90 includes a thumb piece 92 pivotably mounted in the door 4 above a pull handle 94 which is positioned on the outside of the door. The thumb piece 92 includes a tail portion 96 extending through the door into the active case 6. An action lever 98 is pivotably mounted on the pivot pin 28 and includes a downwardly extending portion 100 having a bottom cam surface 102 positioned immediately above the tail portion 96 of the manual operator 90.

The action lever 98 also includes an upwardly extending portion 104 which has a cam lever 106 pivotably attached thereto by pivot pin 107. The cam lever 106 includes a first downwardly extending portion 108 having an outer cam surface 110 which is positioned inwardly of and in alignment with the tail portion 36 of the latch bolt 16. The downwardly extending portion 108 extends downwardly along the latch bolt side of the upperwardly extending portion 104 of the action lever 98. The cam lever 106 also includes a second downwardly extending portion 112 which extends along the other side of the upwardly extending portion 104 of the action lever 98. The portion 112 is provided with an outwardly extending boss 114 in which is mounted a pin 116 which extends horizontally in front of the upwardly extending portion 104 of the action lever 98. Extending upwardly from a crossbar portion 118 of the cam lever which connects portions 108 and 112 is an upwardly extending portion 120 having an outer cam face 122. As shown in FIGS. 2 and 9, the inner portion of the active lever 12 may be provided with a stop plate 123 which may be either a separate member or formed integral therewith, which forms a stop for the action lever 98.

To provide a means for locking and unlocking the door 4 from the outside, a conventional lock cylinder 124 is mounted in the door for access from the exterior thereof as shown in FIG. 2. This lock cylinder may be any conventional key operated cylinder and includes an operating spindle or tail 126 which extends into the active case 6 and is connected to a locking hub 128 which is pivotably mounted in a boss 129 extending outwardly from the backplate 20. The locking hub 128 includes two circumferentially spaced camming arms 130 and 132.

Figure 4:
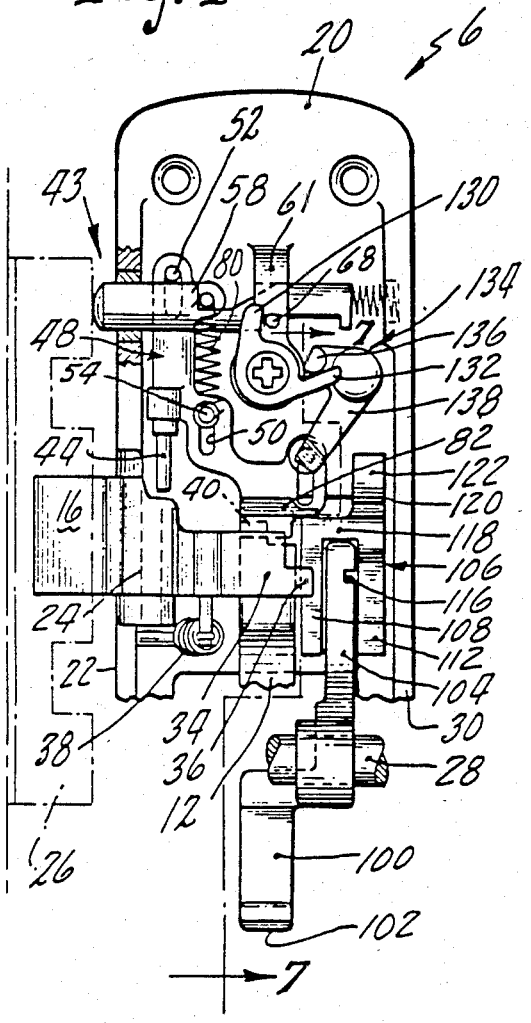
FIG. 4 is a partial elevational view of the active case of FIG. 1 with the cover removed and components shown in an arc position.

A locking member 134 is pivotably attached to the backplate 20 and includes one outwardly extending post 136 which extends between the cam arms 130 and 132 as shown in FIGS. 3 and 4. The locking member 134 is movable by the locking hub 128 from its unlocked position shown in FIG. 3, wherein a locking arm 138 on the locking member 134 is positioned immediately in front of the cam face 122 of the cam lever 106, and a locked position shown in FIG. 4, wherein the locking arm 138 is moved to the side of the cam face 122 of the cam lever 106. A suitable detent mechanism (not shown) may be provided between the inner surface of the locking member 134 and the backplate 20 to releasably hold the locking member in its unlocked and locked positions.

Figure 5:
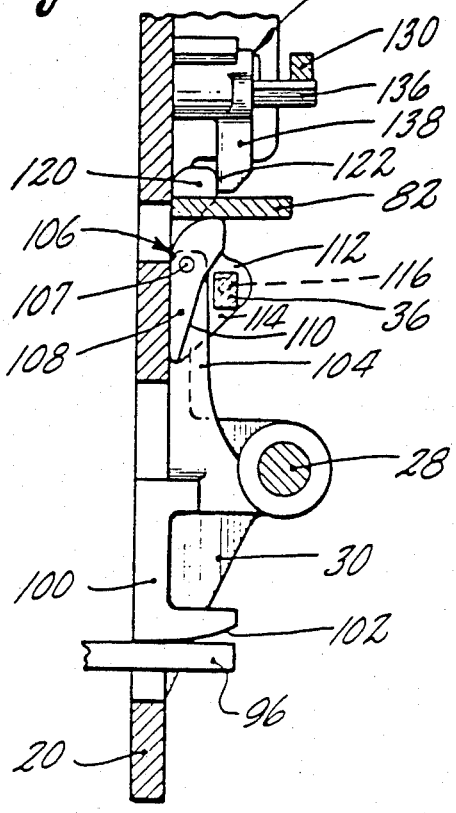
FIG. 5 is a partial sectional view taken along the lines 5—5 of FIG. 3.
Figure 6:
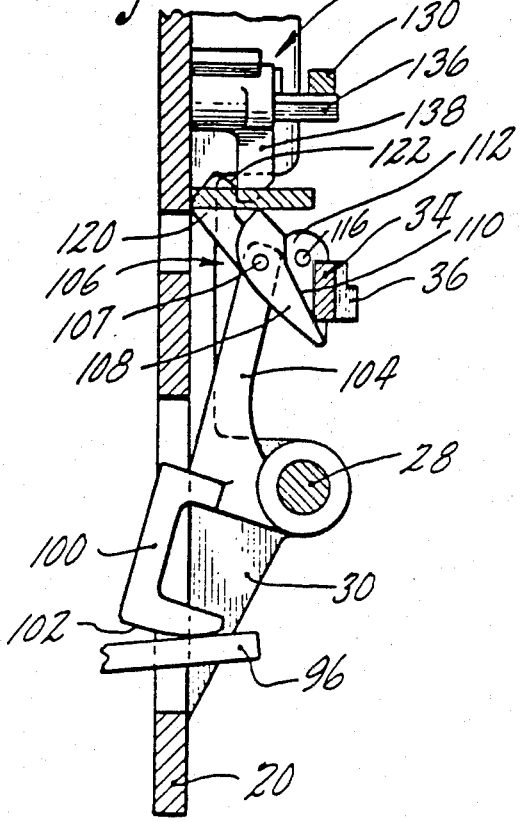
FIG. 6 is a view similar to FIG. 5 but showing the components positioned when the manual operator is moved to its open position.

In operation, when the lock cylinder 124 is used to rotate the locking hub 128 into its unlocked position shown in FIGS. 3, 5 and 6, the locking member 134 is rotated so that the locking arm 138 is positioned immediately in front of the cam face 122 of the cam lever 106. When the manual operator 90 is actuated, the action lever 98 is rotated about pivot pin 28, with the upper portion 104 thereof moving outwardly in a clockwise direction as viewed in FIGS. 5 and 6. As the locking member 134 prevents outward movement of the upwardly extending portion 120 of the cam lever 106, the lower portion 108 moves outwardly and the cam face 110 thereof engages the tail portion 36 of the latch bolt 16 causing the retraction thereof and permitting the door to be opened. At the same time, when the manual operator 90 is actuated and the action lever 98 rotated, the upper surface of the crossbar portion 118 of the cam lever 106 engages a generally horizontal cam surface on the bottom of a cam arm 82 of the retractor member 48, causing the retractor member 48 to move upwardly thereby raising the locking pin 44 to permit free retraction of the latch bolt 16.

Figure 7:
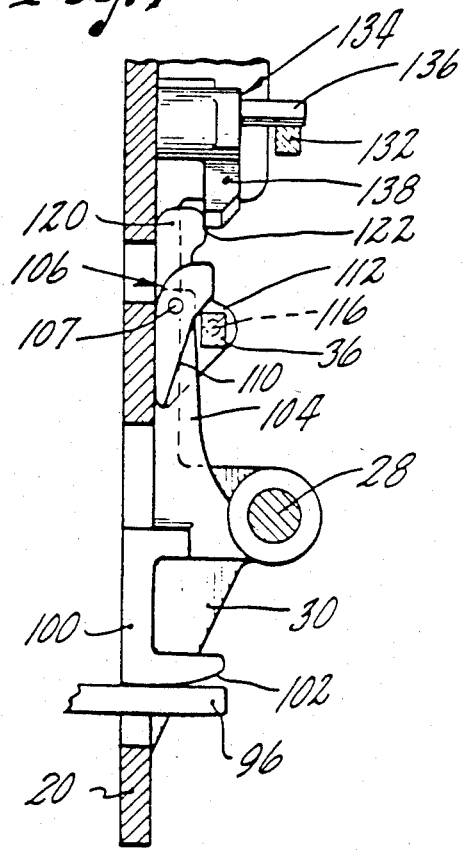
FIG. 7 is a partial sectional view taken along the lines 7—7 of FIG. 4.
Figure 8:
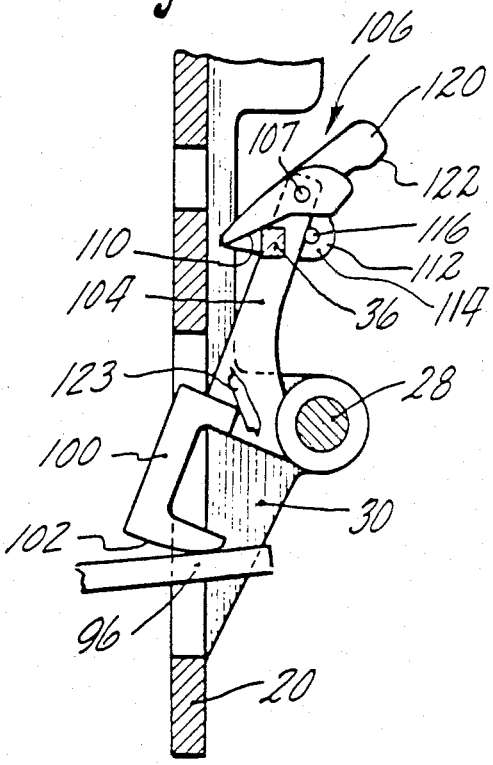
FIG. 8 is a view similar to FIG. 7 but showing the components positioned when the manual operator is moved to its open position.

When the keyed locking cylinder 124 is moved to its locked position, the locking hub 128 is rotated counterclockwise with arm 132 engaging the post 136 on the locking member 134 to move the locking arm 138 to the side of the cam face 122 of the cam lever 106 as shown in FIG. 4. Thus, when the action lever 98 is rotated, the forward face 110 of a downwardly extending portion 108 of the cam lever 106 cams itself up and over the tail portion 34 of the latch bolt 16 and exerts no retracting force thereon. The action lever 98 pivots under the action of the manual operator 90 until the bottom portion thereof engages the stop plate 123 on the active lever 12. When the action lever 98 is rotated when the exit device is locked, the pin 116 in the downwardly extending portion 112 abuts the upper portion of the action lever 98 and prevents the cam lever 106 from rotating too far in a clockwise direction as shown in FIG. 8 so as to render it out of position when it is returned to its normal position shown in FIG. 7.

Thus, by virtue of the present invention, an exit device is provided in which, when the exit device is locked, the manual operator is permitted to move in its normal manner without causing the retraction of the latch bolt 16. It will be noted no matter whether the exit device is locked or unlocked, depression of the crossbar 10 will result in the latch bolt 16 being retracted and the door capable of being opened from the inside.

While reference has been made above to a preferred embodiment of the present invention, it will be apparent to those skilled in the art that various modifications and alterations may be made thereto without departing from the spirit of the present invention. Therefore it is intended that the scope of this invention be ascertained by reference to the following claims:

What is claimed is:

1. An exit device comprising a case, a latch bolt supported by and moveable relative to said case between projected and retracted positions, a manual operator, an action lever pivotably mounted in said case and adapted to be pivoted by said manual operator between an open and closed position, a locking member mounted in said case for movement between a locked and unlocked position, and means mounted on said action lever adjacent one end thereof engageable with said locking member when said locking member is in the unlocked position for causing retraction of said latch bolt when said action lever is pivoted into its open position, and free of engagement of said locking member and cammed about said latch bolt when said locking member is in the locked position, whereby said latch bolt remains projected when said action lever is pivoted into its open position.

2. In an exit device having a latch bolt supported by and moveable relative to an active case between projected and retracted positions, an action lever pivotably mounted in said active case and adapted to be pivoted by a manual operator between an open and closed position, and a locking member mounted in said case for movement between a locked position and an unlocked position, the improvement comprising:

A. a cam lever pivotably connected to said action lever adjacent one end thereof, (i) said cam lever having a first portion engaging said locking member and a second portion engaging said latch bolt to cause the retraction thereof as said action lever is pivoted into its open position when said locking member is in the unlocked position; and (ii) when said locking member is in the locked position, said first portion is free of engagement of said locking member and said second portion is cammed about said latch bolt upon pivoting of said action lever into its open position, whereby the latch bolt remains projected.

3. The exit device of claim 2 wherein said locking member includes an arm portion, said arm portion being in position to be engaged by said first portion of said cam lever when said locking member is in the unlocked position and being out of a position to be engaged by said first portion of said cam lever when said locking member is in said locked position.

4. The exit device of claim 2 further including a dead locking mechanism for preventing retraction of said latch bolt when the dead locking mechanism is activated, said cam lever rendering said mechanisms inactive when said action lever is pivoted into its open position when said locking member is in the unlocked position.

5. The exit device of claim 4 wherein said dead locking mechanism includes a retractor member vertically moveable in said case between an upper inactive position and a lower active position, said retractor member including a cam surface, and said cam lever including a surface engaging said cam surface of said retractor member when said locking member is in the unlocked position and said action lever is pivoted into its open position.

6. The exit device of claim 2 wherein said first portion of said cam lever is on one side of said pivotable connection and said second portion is on the other side thereof.

7. The exit device of claim 6 wherein said first portion is vertically below said second portion.

8. The exit device of claim 2 wherein said cam lever includes means for limiting its pivotal movement.

9. The exit device of claim 8 wherein said means for limiting said pivotal movement includes a pin member on said cam member adapted to engage said action lever when said locking member is in the locked position and said action lever is pivoted into the open position.

10. The exit device of claim 2 further including stop means for limiting the amount of pivot of the action lever into the open position.

11. The exit device of claim 10 further including a lever member having a portion pivotably mounted on the case and operable upon pivotable movement to cause the retraction of said latch bolt, said stop means positioned on said portion of said lever member and engageable by said action lever upon pivoting thereof into its open position when said locking member is in the locked position.

12. In an exit device for a door having a latch bolt supported by and moveable relative to an active case between projected and retracted positions, a lever member on one side of the door operable upon movement to cause the retraction of said latch bolt, a manual operator on the other side of the door, an action lever pivotably mounted in said active case and adapted to be pivoted by said manual operator between an open and closed position, a locking member mounted in said case and adapted to be moved between a locked position and an unlocked position by a lock cylinder, the improvement comprising:

A. a cam lever pivotably connected to said action lever adjacent one end thereof, (i) said cam lever having a first portion engaging said locking member and a second portion engaging said latch bolt to cause the retraction thereof as said action lever is pivoted into its open position when said locking member is in the unlocked position; and (ii) when said locking member is in the locked position, said first portion is free of engagement of said locking member and said second portion is cammed about said latch bolt upon pivoting of said action lever into its open position, whereby the latch bolt remains projected.

* * * * *